US005472193A

United States Patent [19]

Everman

[11] Patent Number: 5,472,193

[45] Date of Patent: Dec. 5, 1995

[54] GYROSCOPICALLY STABILIZED HOCKEY PUCK

[76] Inventor: Michael R. Everman, 4018 B Via Diego, Santa Barbara, Calif. 93110

[21] Appl. No.: 347,645

[22] Filed: Nov. 30, 1994

[51] Int. Cl.[6] ..... A63B 71/00

[52] U.S. Cl. ..... 273/128 R

[58] Field of Search ..... 273/128, 677, 273/126

[56] References Cited

U.S. PATENT DOCUMENTS

| | | | |
|---|---|---|---|
| 4,078,801 | 3/1978 | White, Sr. | 273/128 R |
| 4,153,253 | 5/1979 | White, Sr. | 273/128 R |
| 5,207,720 | 5/1993 | Shepherd | 273/128 R |
| 5,346,214 | 9/1994 | Bruhm | 273/128 R |

FOREIGN PATENT DOCUMENTS

| | | | |
|---|---|---|---|
| 1378871 | 3/1988 | U.S.S.R. | 273/67 A |
| 1718993 | 3/1992 | U.S.S.R. | 273/67 A |

*Primary Examiner*—Raleigh W. Chiu
*Attorney, Agent, or Firm*—Donald D. Mon

[57] ABSTRACT

A hockey puck for playing on surfaces other than ice, for example floors and streets which do not enjoy the smoothness and low coefficient of friction of ice. The puck has a hub, two disc-like face plates, and a bearing joining them so the hub rotates relative to the face plates. The outer peripheral surface of the hub projects radially beyond the face places, and axially recedes from them so the puck can tilt significantly without tripping on the surface.

9 Claims, 1 Drawing Sheet

GYROSCOPICALLY STABILIZED HOCKEY PUCK

FIELD OF THE INVENTION

A hockey puck for play other than on ice, of optimized geometry and combination of materials and parts, both moving and non-moving, in order to enhance the preservation of imparted spin for gyroscopic stability in order to resist tumbling and rolling on rough surfaces.

1. Background of the Invention

With the advent of in-line roller skates, roller hockey has become a sport approaching the popularity of hockey played on ice. Roller hockey leagues are springing up world-wide, and playing surfaces vary widely from rough asphalt to concrete and indoor wood flooring. An annoying occurrence particularly attributed to rough surface play is that the hockey puck itself tends to "catch an edge" and tumble or roll unpredictably. A smooth, sliding motion is generally preferred, as is predominately the case when the playing surface is ice.

The reason for an ice puck's greater stability and glide is the extremely low coefficient of friction between the puck and the ice, but more specifically because the typical hockey pass or shot imparts a spin to the puck that gyroscopically stabilizes the puck for better sliding. The low friction of the ice surface allows the puck its stabilizing spin for a large percentage of the time it is traveling, with the added advantage that the general smoothness of the ice introduces few opportunities to catch one of the edges of the puck, tumbling it. Rough surfaces tend to arrest the spin of a standard roller hockey puck early on in the shot, leaving it vulnerable to irregularities in the surface that would tumble the puck or get it rolling.

Often, rubber balls are used on roller-hockey surfaces in order to more approach the gliding action of a puck on ice, though balls are not generally preferred for serious play. Some currently available pucks have designs that address the desire for smooth gliding with the use of captured balls for a rolling action, or low friction inserts that are replaceable.

Embodiments of this invention do not specifically attempt any innovation in the area of extending its glide on the playing surface, other than geometry which allows selection from a variety of plastic materials with suitable combination of abrasion resistance and low coefficient of friction on rough surfaces. It does, however address the issue of the puck's stability while sliding, with unique approaches to preserving its gyroscopic stability by disassociating in large part the spinning portion of the puck from the playing surface. A by-product of this is that the sliding distances do increase due to the fact that the puck resists turning up on edge by said preservation of its gyroscopic stability. The main advantage being that this construction demonstrates great resistance to tumbling or initiation of a rolling action by an amount approaching an order of magnitude better than a solid puck.

Ice hockey pucks are currently made out of hard rubber, and this is good for two reasons. The traction this material affords between stick face and puck surface allows a greater spin to be imparted to the puck when shot, and it provides a slight softness that may lessen the pain inflicted on a player when he is struck on an unprotected place on the body. Some available roller-hockey puck products have an outer diameter made of hard plastic, and common complaints are that they are more painful to a struck player, and that the pucks do not react in large part like ice hockey pucks. Roller-hockey players as common practice wrap the pucks with electricians tape to enhance the traction and softness.

A further enhancement to all embodiments of this invention is the inclusion of an integral rubber outer ring, either molded on to the assembly, or affixed to the assembly such that the rubber outer ring is replaceable, much like a wheel tire or a rubber band.

Further, a variety of rubber formulations from very hard to very soft can be provided, an advantage being that younger players can use a softer rubber outer rim for enhanced safety.

BRIEF DESCRIPTION OF THE INVENTION

A hockey puck according to this invention includes disk shaped face surfaces of a plastic selected for its abrasion resistance and economy, joined by suitable means at or near the central axis, with an outer ring rotatably mounted to said face surfaces by way of an anti-friction bearing with an axis of rotation coincident with the central axis. The effect being that the central hub and the outer ring can rotate relative to each other.

The outer ring surface is of lesser thickness axially than the total assembly in order to allow its largely unhindered spin when one of the face surfaces is resting or sliding on a playing surface. Geometry of the assembly should be such that the puck can tip up on edge to a significant degree before allowing the outer ring to touch the playing surface which would arrest its stabilizing spin by such contact. Further, the geometry is such that the assembly as a whole does not deviate significantly from the geometry of a standard puck. In its preferred embodiment the outer ring has an elastomeric outer ring surface for enhanced traction and safety, which more closely approaches the generally preferred feel of an ice hockey puck.

Further, the puck according to this invention includes improved geometries and material combinations, such as by the addition of metallic rings as part of the outer ring to maximize the outer ring's moment of inertia about the central rotational axis, in an effort to distribute mass thereby prolonging its imparted stabilizing spin. In general terms: geometry of the device is such that a substantial portion of the mass is, on average, concentrated as near as practical to the outer periphery of the puck, while the surfaces that contact the playing surface are of, on average, of a lesser diameter than that of the puck as a whole, maintaining a stable footing that sufficiently limits tipping.

The above and other features of this invention will be fully understood from the following detailed description and the accompanying drawings in which:

DETAILED DESCRIPTION OF THE INVENTION

Figure 1:
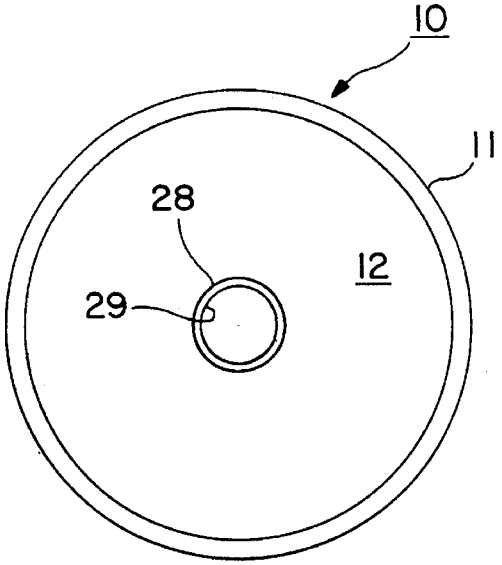
FIG. 1 is a top view of the presently-preferred embodiment.
Figure 2:
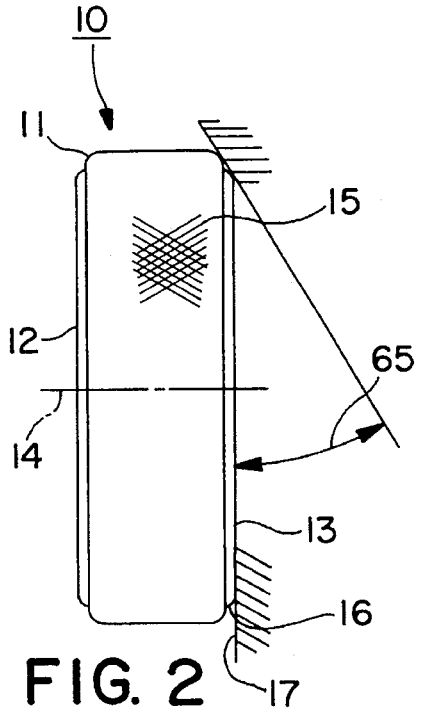
FIG. 2 is a side view of the invention.
Figure 3:
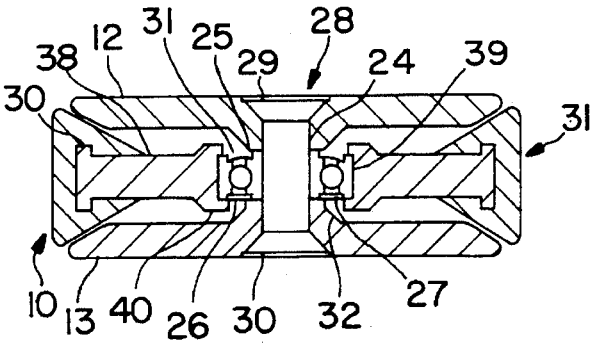
FIG. 3 is an axial cross-sectional view taken at line 3—3 in FIG. 1.

A hockey puck 10 according to this invention is shown in FIGS. 1, 2, and 3 with ring 11 rotatably mounted to face plates 12 and 13, the ring's axis of rotation being concentric with central axis 14 of the puck.

A suitably toughened surface 15 on the outer periphery of said ring may be provided for added traction when contacted by the face of a hockey stick, in order to increase the imparted spin when the puck is passed or shot. The advantage of said imparted spin of said ring being that the spinning ring provides gyroscopic stability to the puck as a whole while the puck is in lateral motion. Sufficient clearance 16 between said ring from playing surface 17 is provided to insure free rotation of the ring when the puck is sliding on said surface.

A more detailed explanation of the puck's inner workings, FIG. 3, will now be given. Face plates 12 and 13 incorporate suitable features 24 in order to orient and retain the inner race 25 of anti-friction bearing 26, said bearing will preferably be of the sealed or shielded radial ball bearing type, said shields or seals 27 are provided for the purpose of excluding particles of dust or sand that would otherwise inhibit free rotation of the ring. Face plates 12 and 13 are connected to one another by a fastener 28 whose shank mounts the inner bearing race. Fastener 28 is shown in FIG. 3 as an upset rivet whose heads 29 and 30 are seated in countersinks in the face plates. Necks 31 and 32 on the face plates bear against the race. The fastening means must withstand severe vibration and shock without loosening appreciably. This fastening function may be alternately accomplished by a removable fastener 34 (FIG. 4) with suitable means of resisting loosening which may be by way of a split or other type washer 36 and in conjunction with a nut 37 or other threaded feature integral to plate 13, which may alternately contain the thread-locking feature.

Ring hub 38 is configured in order to retain and orient said hub onto the outer race 39 of bearing 26 by way of suitable features 40 integral to said hub which are deformed by heat or incorporate other retention means such as a snap ring or plurality of rings 41 in order to fully capture said outer race axially. This capturing function may alternately be accomplished by a two-piece hub in a clam-shell fashion, said pieces bonded, welded or fastened together in order to capture the bearing.

While the outer ring features may be formed integral to, and of the same material as the hub, which would then be necessarily of a harder, thermal or pressure formable plastic material in order to have sufficient strength for attachment to the bearing, the preferred embodiment of the invention includes an outer ring 45 formed of rubber, or other elastomer such as urethane for enhanced safety and traction at the outer diameter. Said rubber ring may be molded integral to said hub which may now be made of a variety of materials not limited to plastics. Said hub may include suitable features such as peripheral flanges 30 integral to its periphery which both lessens the rubber's stress at impact, and provides enhanced mechanical retention of said rubber ring. Alternately, rubber ring 31 may be configured such that it is bonded to said hub at assembly, or not bonded and meant to be replaceable by the user.

Figure 4:
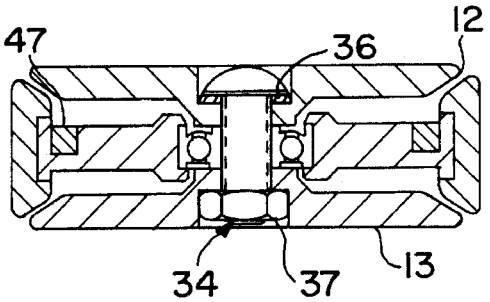
FIG. 4 is a cross-sectional view similar to FIG. 3 of a modified embodiment of the invention.

Since the main function of the outer ring and hub assembly is to provide the puck with gyroscopic stability, methods of increasing the ring's moment of inertia about the central axis may be advantageous. The advantage being that a higher moment of inertia requires less imparted spin for a given amount of stability. Said increase of inertia may be brought about by the addition of a metallic insert or inserts near the periphery which by way of example might be ring or rings 47 suitably attached to the hub or to the interior of the outer rubber ring (FIG. 4). A further method of increasing said inertia would be the addition of metallic powder, but not limited to metallics, mixed in suitable proportion to the rubber material of the outer ring itself. The ring will thereby be increased in moment of inertia in a simple fashion.

Figure 5:
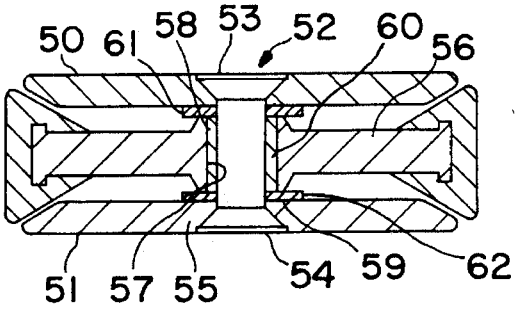
FIG. 5 is a cross-sectional view similar to FIG. 3 of yet another embodiment of the invention.

The embodiments of FIGS. 1–4 utilize roller or ball type bearings, which are expensive. FIG. 5 shows a construction able to utilize a simple friction type bearing which will be suitable for all but the most demanding applications.

Face plates 50, 51 are joined by a rivet 52 having heads 53, 54 and a cylindrical shank 55. A hub 56 of any construction already described has an inner cylindrical bearing surface 57 and two end bearing surfaces 58, 59. A bearing sleeve 60 fits on shank 55. The sleeve is a hollow cylinder. Two end plates 61, 62 bear against the sleeve to position it, and against end surfaces 58, 59. The sleeve and end plates thereby form an inner bearing race, on which the hub rotates.

An angle 65 is shown in FIG. 2. This is the angle of tilt which represents the maximum tip of the puck before the hub contacts the surface. Preferably this angle will be as great as 30 degrees, and is created by the axial spacing of the edges of the hub from the edges of the end plate, and of their axial separation.

The spacing between the hub and the end plates should be sufficient that small particles will not enter and jam the puck against rotation, but also small enough to exclude very large particles. About 1/32 inches is about right.

This invention is not to be limited by the embodiments shown in the drawings and described in the description, which are given by way of example and not of limitation, but only in accordance with the scope of the appended claims.

I claim:

1. A hockey puck for play on playing surfaces other than ice which do not enjoy the smoothness and low coefficient of friction of ice, said puck being circular and having a central axis, said puck comprising:

a first and a second disc-like face plate, each having a face for contact with said surfaces;

a hub between said face plates;

bearing means between said face plates freely rotating said hub between said face plates;

fastener means joining said face plates, hub and bearing means, there being clearance between said face plates and hub to enable the hub to rotate freely relative to said face plates;

said hub having an outer peripheral surface that projects radially beyond both of said face plates, and recedes axially from their outer faces to provide edge clearance from said playing surfaces when the puck is tilted relative to the playing surface.

2. A puck according to claim 1 in which said bearing means is a roller bearing.

3. A puck according to claim 1 in which said bearing means is a ball bearing.

4. A puck according to claim 1 in which said fastener means is a nut and bolt combination.

5. A puck according to claim 1 in which said fastener means is a rivet.

6. A puck according to claim 1 in which said fastener means includes a shank, and in which said bearing comprises a sleeve on said shank, a pair of end bearing plates on each side of said shank, and on the hub an internal surface bearing against said sleeve and end surfaces bearing against said end bearing plates.

7. A puck according to claim 1 in which said hub comprises a central portion and a peripheral ring-like outer portion, said portions being made of different materials.

8. A puck according to claim 7 in which the material of said outer portion is softer than the remainder of the hub.

9. A puck according to claim 1 in which a ring of denser material is incorporated in said hub at a substantial spacing from said central axis.

* * * * *